US007200351B2

(12) United States Patent
Ikeda et al.

(10) Patent No.: US 7,200,351 B2
(45) Date of Patent: Apr. 3, 2007

(54) IMAGE FORMING APPARATUS FEATURING A DEVELOPING DEVICE WHICH ABUTS AND RETRACTS FROM AN IMAGE BEARING MEMBER

(75) Inventors: Taro Ikeda, Chiba (JP); Hiroyuki Sekine, Aichi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/168,569

(22) Filed: Jun. 29, 2005

(65) Prior Publication Data

US 2005/0238375 A1 Oct. 27, 2005

Related U.S. Application Data

(62) Division of application No. 10/687,815, filed on Oct. 20, 2003, now Pat. No. 6,970,671.

(30) Foreign Application Priority Data

Oct. 31, 2002 (JP) ..... 2002-317297

(51) Int. Cl.
*G03G 15/01* (2006.01)

(52) U.S. Cl. ..... 399/227

(58) Field of Classification Search ..... None
See application file for complete search history.

(56) References Cited

U.S. PATENT DOCUMENTS

| | | | | |
|---|---|---|---|---|
| 4,713,673 | A * | 12/1987 | Kessoku | 399/227 |
| 4,728,987 | A * | 3/1988 | Diola et al. | 399/227 |
| 5,153,659 | A * | 10/1992 | Maiefski et al. | 399/227 |
| 5,160,969 | A | 11/1992 | Mizuma et al. | 399/223 |
| 5,258,819 | A | 11/1993 | Kimura et al. | 399/119 |
| 2001/0055494 | A1 * | 12/2001 | Katakabe et al. | 399/27 |

FOREIGN PATENT DOCUMENTS

| | | |
|---|---|---|
| JP | 11-002961 | 12/1997 |
| JP | 2000-147900 | 5/2000 |

* cited by examiner

*Primary Examiner*—Quana Grainger
(74) *Attorney, Agent, or Firm*—Fitzpatrick, Cella, Harper & Scinto

(57) ABSTRACT

An image forming apparatus includes a photosensitive drum, a charging roller, a transfer roller, and a toner charging brush, wherein the toner charging brush reciprocates in a longitudinal direction of the photosensitive drum. In the image forming apparatus, when a number of rotations per a unit time of the image bearing member is assumed to be "a" and a number of times of reciprocation per unit time of the toner charging brush is assumed to be "b" assuming that R=b/a, R is set to be in a range of $1/25 \leqq R \leqq 3$. However, R=m/n (m and n are integers of 5 or less) is excluded. Consequently, generation of a periodic attachment pattern appearing on the photosensitive drum is eliminated.

2 Claims, 4 Drawing Sheets

IMAGE FORMING APPARATUS FEATURING A DEVELOPING DEVICE WHICH ABUTS AND RETRACTS FROM AN IMAGE BEARING MEMBER

CROSS-REFERENCE TO RELATED APPLICATION

This application is a divisional of application Ser. No. 10/687,815, filed Oct. 20, 2003 now U.S. Pat. No. 6,970,671.

BACKGROUND OF THE INVENTION

1. Field of the Invention

The invention relates to an image forming apparatus adopting an electrophotographic process or an electrostatic recording process, and particularly to an image forming apparatus such as a copying machine, a printer or a facsimile apparatus.

2. Description of Related Art

In an image forming portion in an image forming apparatus such as a copying machine, a photosensitive member which is an image bearing member is charged by a charging apparatus, and is exposed to the image of an original at an exposure position by an exposing optical system to thereby form an electrostatic latent image on the peripheral surface of the photosensitive member, and this electrostatic latent image is developed by a developing apparatus to thereby form a developer image (toner image), and this toner image is transferred to a transferring material by the application of a voltage by a transferring apparatus, and the photosensitive member after the transfer is cleaned by a cleaning apparatus, whereafter exposure before charging is effected to thereby remove any residual charges on the photosensitive member, and the above-described process is repeated again to thereby effect image forming.

There has also been proposed an image forming apparatus which is provided with a plurality of photosensitive members, charging apparatuses and developing apparatuses and repeats the above-described image forming process a plurality of times to thereby form a full-color image.

Further, in the above-described image forming apparatus for forming a full-color image, it has heretofore been proposed to provide a plurality of developer carrying members (hereinafter referred to as the developing sleeves) in the developing apparatuses.

In this case, the developing sleeves are disposed with a predetermined clearance relative to the photosensitive members, but it is possible to form images of high definition at a high speed without greatly increasing the peripheral speed of the developing sleeves.

Also, in the black-and-white image forming apparatus of Japanese Patent Application Laid-Open No. 2000-147900 which has a developing device provided with a plurality of developing sleeves and fixedly disposed around a photosensitive member, there is proposed a method of pressing one developing sleeve against the photosensitive member with the other developing sleeve as a fulcrum.

The above-described full-color image forming apparatus, however, tends to become bulky and has posed a problem in this point. That is, neither of the higher speed and higher quality of image and the downsizing of the image forming apparatus could be made compatible.

SUMMARY OF THE INVENTION

It is an object of the present invention to provide an image forming apparatus which can make both of the higher speed of image forming and the downsizing of the image forming apparatus compatible.

It is another object of the present invention to provide an image forming apparatus which can make both of a higher quality of image in image forming and the downsizing of the image forming apparatus compatible.

It is another object of the present invention to provide an image forming apparatus in which a plurality of developer carrying members can be accurately positioned relative to an image bearing member by a simple construction.

Further objects of the present invention will become apparent from the following detailed description when read with reference to the accompanying drawings.

DESCRIPTION OF THE PREFERRED EMBODIMENTS

Some embodiments of the present invention will hereinafter be described with reference to the drawings.

Figure 1:
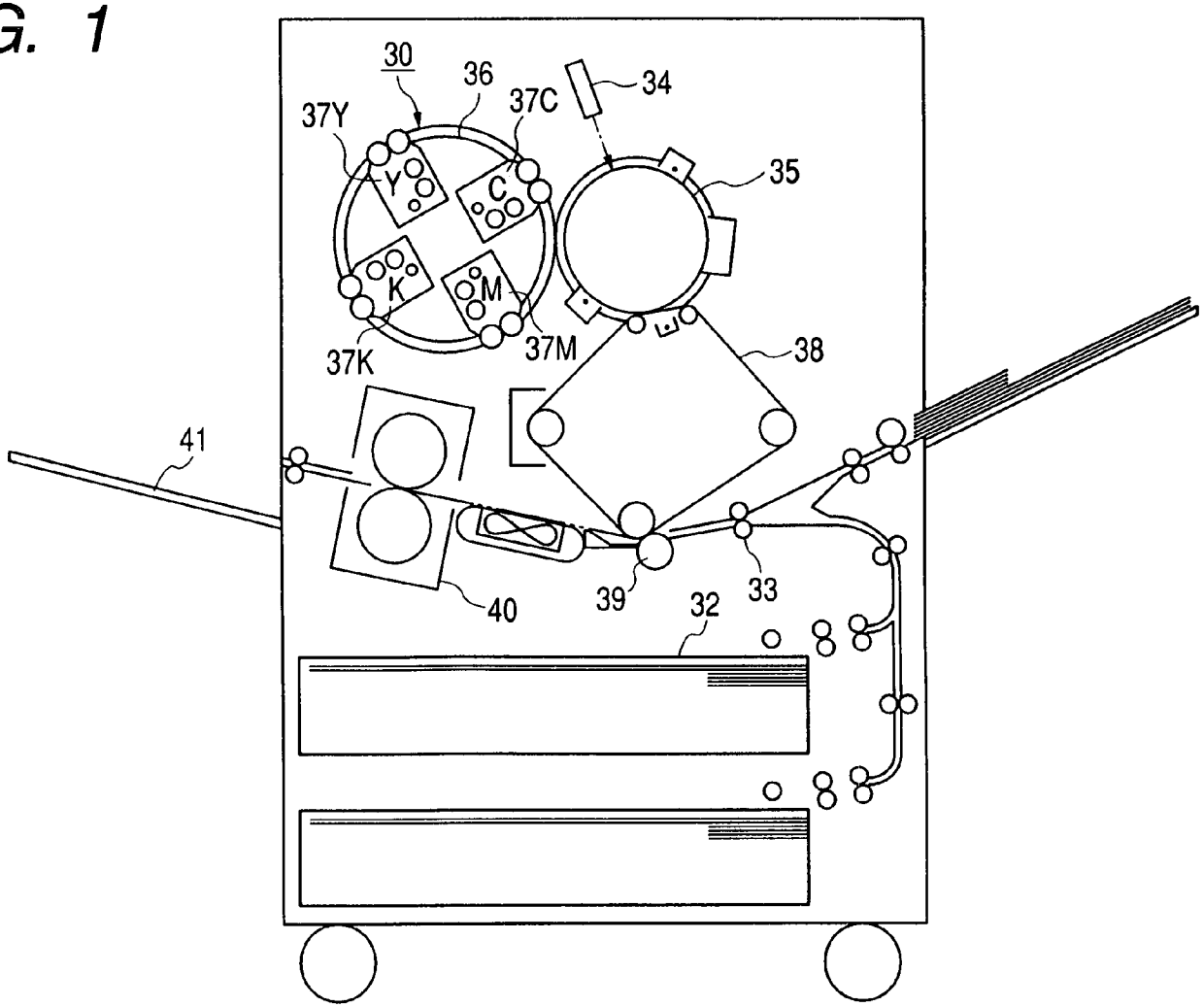
FIG. 1 is a schematic cross-sectional view of a full-color copying apparatus provided with a developing apparatus according to the present invention.

FIG. 1 is a schematic cross-sectional view of a full-color printer provided with a developing apparatus according to the present invention.

In the full-color printer of FIG. 1, the image information of an original read by an image reading portion (not shown) is processed by an image processing portion (not shown). For example, a recording sheet (not shown) fed from a cassette sheet feeding portion 32 has its skew feeding corrected at a registering portion 33 and comes to a secondary transferring portion 39.

On the other hand, the image data processed by the image processing portion (not shown) is recorded as a latent image on a photosensitive drum 35 by a laser scanner portion 34. When a full-color image is to be formed, the latent image is developed by a rotary type developing apparatus 30. Here, the rotary type developing apparatus 30 develops the latent image on the photosensitive drum 35 as toner images of four colors while changing over a plurality of (four) developing devices 37K (black), 37C (cyan), 37M (magenta) and 37Y (yellow) to a rotary containing portion 36. The toner images of four colors are superimposed and primary-transferred onto an intermediate transferring belt 38, and the toner images on the intermediate transferring belt 38 are collectively transferred to the recording sheet at the secondary transferring portion 39. The toner image on the recording sheet is fixed on the recording sheet by a fixing portion 40, and the recording sheet having the toner image thereon fixed is discharged to a sheet discharging portion 41.

A description will now be made of the action of the rotary type developing apparatus according to the present invention.

First, as a premise, when the rotary type developing apparatus 30 provided with two developing sleeves is used, both of the higher speed (or higher quality of image) of image forming and downsizing can be made compatible.

FIGS. 2 to 5 show the developing operation of the rotary type developing apparatus 30 provided with two developing sleeves. For simplicity, a developing device 37 alone is taken as an example and the action thereof will hereinafter be described. The other developing devices are also similar in construction.

Also, the electrostatic image formed on the photosensitive drum 35 is adapted to be developed by a developing sleeve S1 and a developing sleeve S2 which will be described later, in the named order.

Figure 2:
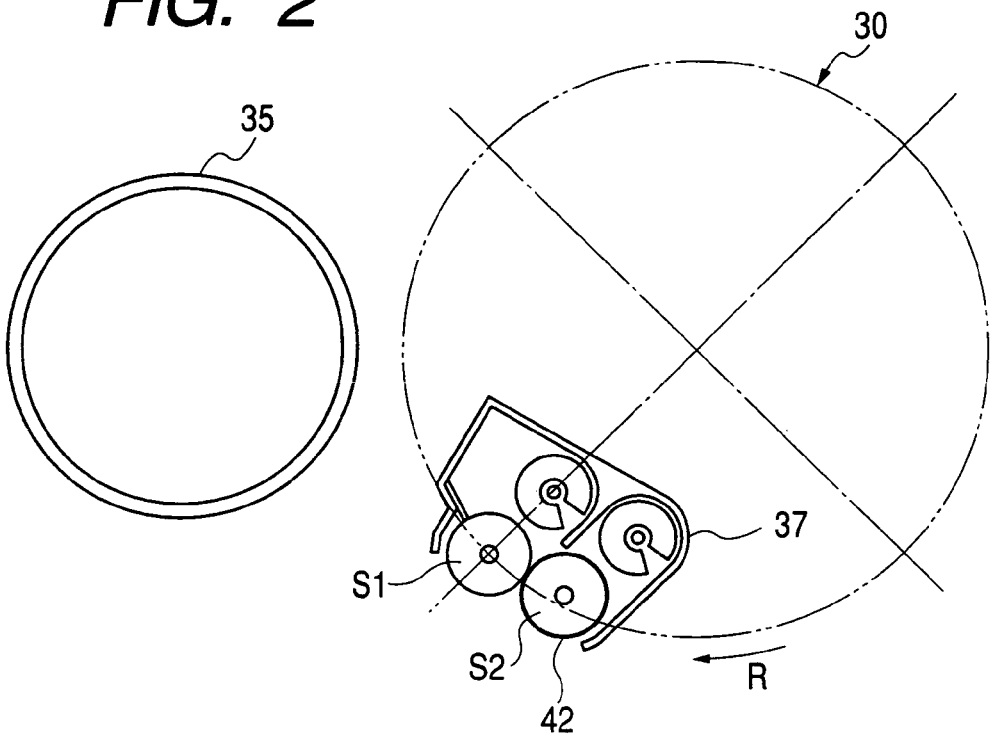
FIG. 2 is a cross-sectional view illustrating the developing operation of the developing apparatus according to the present invention.

Referring to FIG. 2, a regulating member 42 for ensuring a gap (hereinafter referred to as the SD gap) with respect to the photosensitive drum 35 is mounted on the developing sleeve S2 outside a developing area, often on the opposite end portions thereof.

Figure 3:
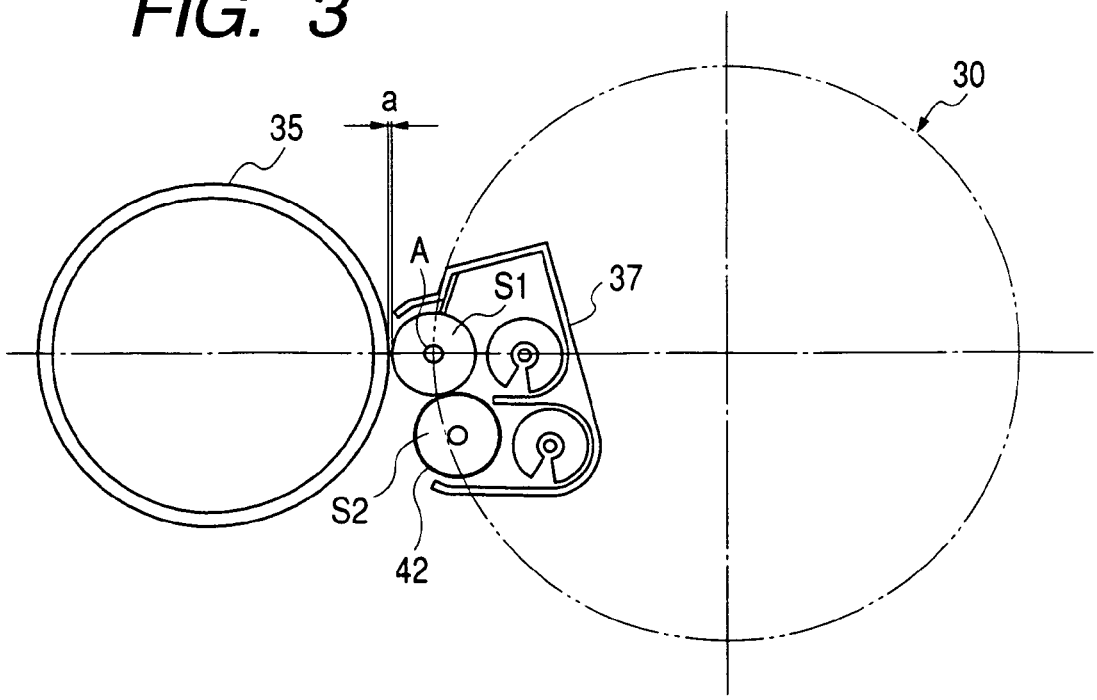
FIG. 3 is a cross-sectional view illustrating the developing operation of the developing apparatus according to the present invention.

FIG. 2 shows the retracted positions of the developing sleeves S1 and S2 in the developing device 37 being rotated, and the developing sleeve S2 on the downstream side with respect to the direction of rotation (the direction indicated by the arrow R) of the developing device 37 is retracted to a position in which it does not interfere with the photosensitive drum 37 when the rotary type developing apparatus 30 is being rotated. When the developing sleeve S1 on the upstream side comes to a developing position, the rotation of the rotary type developing apparatus 30 is stopped. At this time, as shown in FIG. 3, the photosensitive drum 35 and the developing sleeve S1 are adjusted so that the gap between the two may be "a", and this also holds true of the other developing devices.

Figure 4:
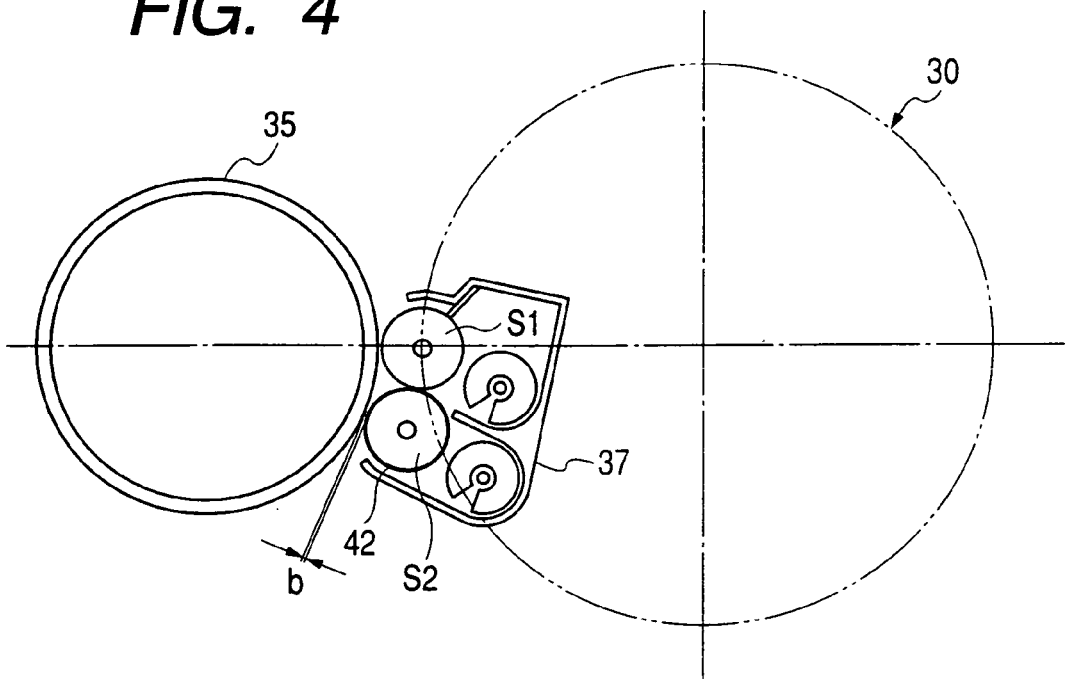
FIG. 4 is a cross-sectional view illustrating the developing operation of the developing apparatus according to the present invention.

When in the above-described state, predetermined developing is effected by the developing sleeve S1, the developing device 37 is rotated about the center of rotation A of the developing sleeve S1 by driving means (not shown) to a position in which the regulating member 42 for ensuring the gap between the photosensitive drum 35 and the developing sleeve S2 contacts with the photosensitive drum 35, as shown in FIG. 4. Thereupon, the gap between the photosensitive drum 35 and the developing sleeve S2 is kept at a predetermined value "b", and predetermined developing is effected by the developing sleeve S2.

Figure 5:
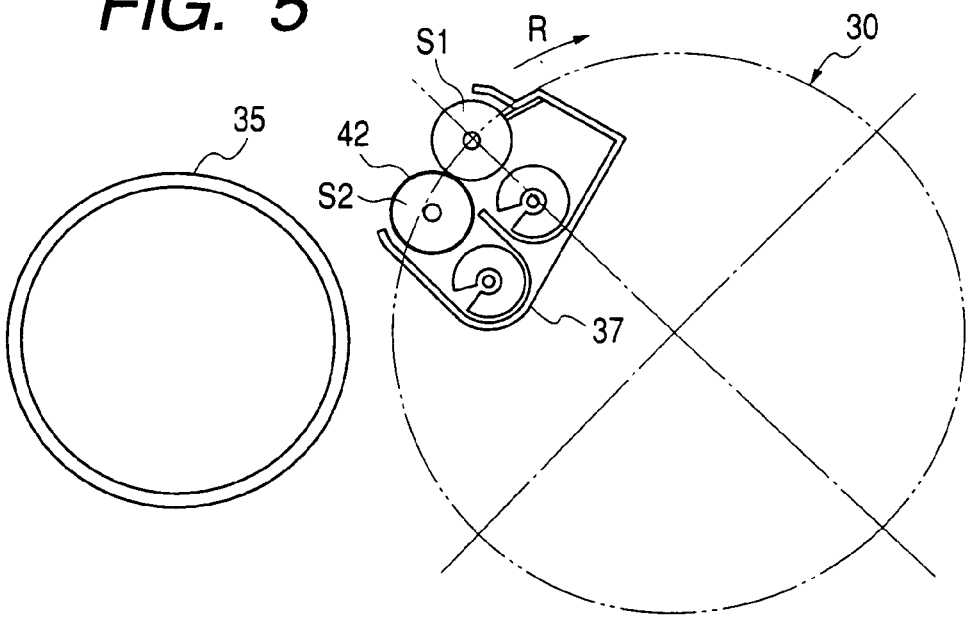
FIG. 5 is a cross-sectional view illustrating the developing operation of the developing apparatus according to the present invention.

After the termination of the developing, the developing device 37 or the developing sleeve is rotated (retracted) to a position in which the developing sleeve S2 does not interfere with the photosensitive drum 35 even if the rotary type developing apparatus 30 is rotated, whereafter the rotary type developing apparatus 30 is rotated (see FIG. 5).

The timing at which the movement of the developing sleeve S2 to the developing position is started may be before the rotation of the rotary type developing apparatus 30 is stopped, and by doing so, the changeover time can be made shorter than that by rotating the developing device 37 after the rotary type developing apparatus 30 is stopped.

Thus, according to the present embodiment, a design is made such that after the predetermined developing has been effected by the use of the developing sleeve S2, the developing device 37 or the developing sleeve S2 is rotated (retracted) to the position in which the developing sleeve S2 does not interfere with the photosensitive drum 35 and therefore, the plurality of developing sleeves S1 and S2 of each developing device 37 can be disposed in proximity to the photosensitive drum 35.

Also, a design is made such that the developing sleeve S1 is positioned by the developing device 37 so as to form the predetermined gap (SD gap) "a" between it and the photosensitive drum 35, and the developing device 37 is rotated to thereby bring the position-regulatable regulating member 42 provided on the developing sleeve S2 into contact with the photosensitive drum 35 and form the predetermined gap (SD gap) "b" between the developing sleeve S2 and the photosensitive drum 35 and therefore, the gaps (SD gaps) "a" and "b" between the photosensitive drum 35 and the developing sleeves S1, S2 can be positioned very accurately.

While in the foregoing, a description has been made of a case where developing is effected by the developing sleeve S1, whereafter developing is effected by the developing sleeve S2, the developing by the developing sleeve S1 and the developing by the developing sleeve S2 may be started at a time after the developing sleeves S1 and S2 have been stopped at the developing position. Also, a design may be made such that a mode in which the rotation of the developing sleeve S2 is selectively controlled and developing is effected by the developing sleeve S1 alone, and a mode in which developing is effected by the use of both of the developing sleeves S1 and S2 are set to thereby set a high image quality mode, a standard image quality mode, a high speed output mode, etc. so as to enable a user to select the modes with the quality of image, the output time, etc. taken into account.

A description will now be made of a modification according to the present invention, i.e., not the construction in which the regulating member of the developing sleeve as described above is directly abutted against the photosensitive drum, but an example in which the regulating member is indirectly abutted against the photosensitive drum to thereby ensure the distance between the photosensitive drum surface (image forming area) and the developing sleeve surface (image forming area).

Figure 6:
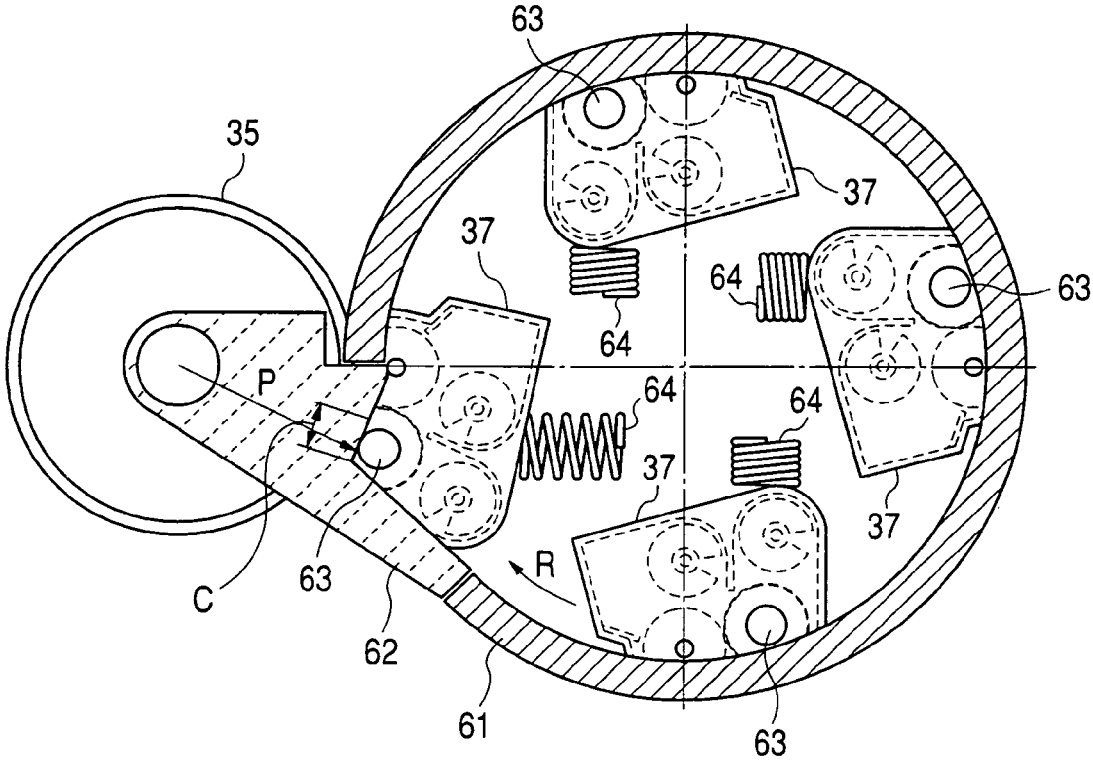
FIG. 6 is a cross-sectional view of the developing device positioning mechanism of the developing apparatus according to the present invention.

FIG. 6 is a cross-sectional view of a positioning mechanism for the developing device (the developing sleeve S2 on the downstream side) 37.

The positioning of the developing device 37 is done by pressing the developing device 37 against a developing device rotating rail 61 and a developing position determining rail 62 by means of a pressure spring 64, and abutting a runner 63 against the rail 62.

The developing device rotating rail 61 is for determining the position of the developing device 37 when not used, and holds the runner 63 of the developing device 37 in its retracted position so that during the rotation of the rotary type developing apparatus 30, the developing sleeve S2 may not interfere with the photosensitive drum 35.

Also, the developing position determining rail 62 is a member for guiding the developing sleeve S2 on the downstream side to the developing position as the developing device 37 approaches the developing position, and when the developing sleeve S1 on the upstream side leaves the developing position, the developing position determining rail 62 contains the developing device 37 in the rotary type developing apparatus 30 so that the developing sleeve S2 on the downstream side may not interfere with the photosensitive drum 35. The developing position determining rail 62 is mounted on the rotary shaft of the photosensitive drum 35, and the gap (hereinafter referred to as the SD gap) between the developing sleeve S2 on the downstream side and the photosensitive drum 35 is accurately positioned by a portion of the developing position determining rail 62. The developing position determining rail 62, if its accuracy can be ensured, need not be mounted on the rotary shaft of the photosensitive drum 35, and the developing position determining rail 62 may be adjusted so that a desired SD gap may be obtained.

The developing position determining rail 62 has a portion having a curvature of a radius P about the center of the photosensitive drum 35 within a range C which determines the SD gap of the developing sleeve S2 on the downstream side, whereby even if the stopped position of the rotary type developing apparatus 30 deviates, the SD gap of the developing sleeve S2 on the downstream side can be ensured.

Also, as previously described, the developing device rotating rail 61 retracts the developing device 37 by a minimum amount for which the developing sleeve S2 does not interfere with the photosensitive drum 35, but it may be designed to further retract the developing device 37 and suppress the moment of inertia of the rotary type developing apparatus 30 to a small value to thereby reduce the load of the driving motor of the rotary type developing apparatus 30.

As is apparent from the foregoing description, according to the present embodiment, both higher speed (higher quality of image) of image forming and downsizing of the image forming apparatus can be made compatible. In addition, the developer carrying member can be positioned very accurately with a predetermined gap with respect to the image bearing member.

What is claimed is:

1. An image forming apparatus comprising:

a drum-shaped image bearing member on which an electrostatic image is formed;

a developing device, which develops the electrostatic image with a developer at a developing position;

a rotary member holding said developing device and rotating in a predetermined direction to cause a rotational movement of said developing device in a route including the developing position;

a first developer carrying member rotatably provided in said developing device for carrying the developer to develop the electrostatic image, said first developer carrying member being disposed in said developing device so as to be opposed to said image bearing member with a first gap between said image bearing member and said first developer carrying member when said developing device is at the developing position;

a second developer carrying member rotatably provided upstream of said first developer carrying member in the predetermined direction in said developing device for carrying the developer to develop the electrostatic image; and an abutting member provided on said second developer carrying member for forming a second gap between said image bearing member and said second developer carrying member by abutting against said image bearing member when said developing device is at the developing position, wherein said rotary member holds said developing device to cause a pivot movement of said developing device between an abutting attitude in which said abutting member abuts against said image bearing member and a retracting attitude in which said abutting member is separated from said image bearing member, a pivot center of said pivot movement being aligned with a rotation center of said first developer carrying member, and wherein, after a developing operation is completed in a state in which said developing device, which is in the developing position, assumes the abutting attitude, said developing device is moved to the retracting attitude, and thereafter, said rotary member causes the rotational movement of said developing device, which is at the developing position, in the predetermined direction.

2. An image forming apparatus according to claim 1, wherein before said developing device arrives at the developing position by a rotation of said rotary member, said developing device starts the pivot movement from the retracting attitude to the abutting attitude.

* * * * *

UNITED STATES PATENT AND TRADEMARK OFFICE

CERTIFICATE OF CORRECTION

PATENT NO. : 7,200,351 B2
APPLICATION NO. : 11/168569
DATED : April 3, 2007
INVENTOR(S) : Ikeda et al.

It is certified that error appears in the above-identified patent and that said Letters Patent is hereby corrected as shown below:

ON THE COVER PAGE:
At (56) References Cited, FOREIGN PATENT DOCUMENTS

"JP 11-002961 12/1997" should read --JP 11/002961 1/1997--.

COLUMN 4:
Line 31, "etc." should read --etc.,--
Line 32, "etc." should read --etc.,--.

Signed and Sealed this

Eighteenth Day of March, 2008

JON W. DUDAS
*Director of the United States Patent and Trademark Office*